United States Patent [19]

Jongeward

[11] 4,236,841

[45] Dec. 2, 1980

[54] SUSPENSION SYSTEM FOR WRITING IMPLEMENTS

[76] Inventor: John H. Jongeward, 709 8th St., Yuma, Ariz. 85364

[21] Appl. No.: 27,506

[22] Filed: Apr. 5, 1979

Related U.S. Application Data

[63] Continuation-in-part of Ser. No. 848,111, Nov. 3, 1977, abandoned.

[51] Int. Cl.[3] ..... B43K 23/02

[52] U.S. Cl. ..... 401/131; 248/331; 248/52

[58] Field of Search ..... 248/51, 52, 327, 331, 248/332, 364; 401/131

[56] References Cited

U.S. PATENT DOCUMENTS

| | | | |
|---|---|---|---|
| 460,178 | 9/1891 | Matteson | 248/331 |
| 1,067,554 | 7/1913 | Sachs | 248/331 |
| 1,103,955 | 7/1914 | Garon | 401/131 X |
| 1,328,248 | 1/1920 | Pieper | 248/331 |
| 1,392,503 | 10/1921 | Seldomridge | 248/331 |
| 2,926,631 | 3/1960 | Palmer | 401/131 X |

*Primary Examiner*—Edward M. Coven

*Attorney, Agent, or Firm*—Cahill, Sutton & Thomas

[57] ABSTRACT

Apparatus for retractably extending an overhead supported writing implement maintains a uniform light retraction force upon the writing implement regardless of the degree of extension of the writing implement.

10 Claims, 6 Drawing Figures

SUSPENSION SYSTEM FOR WRITING IMPLEMENTS

The present application is a continuation-in-part application based upon my copending application entitled "Suspension System for Writing Implements," filed Nov. 3, 1977, and assigned Ser. No. 848,111, now abandoned.

The present invention relates to suspension systems and, more particularly, to overhead suspension systems for writing implements.

In many businesses, such as retail stores, warehouses, and offices, certain locations are used by a multitude of personnel for various administrative functions requiring the use of a writing implement. Often, the writing implement is attached to a fixture at the location by a chain or the like, which chain precludes inadvertent removal of the writing implement but also limits the physical proximity within which the writing implement may be employed. A longer chain can be incorporated but a longer chain promotes disorder and inconvenience at the location. To overcome the detriments of a chain attached writing implement, a source of unattached writing implements can be made available; however, the expenses attendant lost or misplaced writing implements can be onerous.

To overcome the detriments of a chain, while maintaining an adequate degree of extension of the writing implement from an anchor point, various devices have been developed which incorporate rubber bands, windup mechanisms or springs. The difficulties encountered with these types of devices are numerous. First, the tension attendant the writing implement is generally proportional to the degree of extension from the anchor point. Thus, the pull exerted upon the writing implement renders natural and easy writing difficult or impossible. Second, the writing implement will tend to snap back were it released without manually regulated retraction. Third, special attachment fittings must generally be employed with the writing implement to secure it to the device; thereby the use of inexpensive commercially available writing implements is generally precluded.

By retractably suspending a writing implement from an overhead location, the surface upon which the writing is made will not be cluttered. Thus, the irritations and limitations attendant work surface or desk mounted writing implements are overcome.

Various prior art devices exist which accommodate retractable suspension of various types of elements. In example, U.S. Pat. No. 416,447 illustrates and describes a lamp supported by a pulley system wherein the vertical position of the lamp is lockably adjustable to a given height. U.S. Pat. No. 460,178 is directed to a lamp supporting pulley system having adjustable weights to watch the weight of the lamp. U.S. Pat. Nos. 613,098 and 1,067,554 each illustrate a drop light suspended by a pulley system incorporating a counterweight which, in combination with the induced friction of the pulley system, maintains the lamp at any given height. Various pulley related mechanisms useable in either of the above discussed systems are described in U.S. Pat. Nos. 2,770,142, 2,287,968 and Des. 132,848. U.S. Pat. No. 1,392,530, describes a counterweight suspension device for tools. The suspended tool is maintainable within a range of vertical positions through the use of a force proportional friction inducing device engaging opposed supporting cords. Because of the friction inducing device, the counterweight need not exactly match the weight of the supported tool in order for the tool to remain in a selected vertical position. U.S. Pat. No. 1,328,448 is directed to a counterweight suspension system for lamps which incorporates a ratchet system to prevent slow vertical motion of the lamp but permit rapid vertical motion.

For anchored writing implements it is particularly important for ease of use that, at most, a minimum force be exerted upon the writing implement by the anchoring element. Moreover, it is preferable that the anchoring element not lie or rest upon the writing work surface or document. The present invention achieves these results by incorporating an overhead supported suspension system. The retraction force for the writing implement is provided by a counterweight. The mass of the counterweight is minimized to establish a gravity induced force just sufficient to overcome the force of gravity acting upon the writing implement and attendant cord and the friction force present and to provide a gentle retraction force to raise the writing implement. The friction attendant the suspension system is minimized to the greatest extent possible by incorporating a specially designed pivotally suspended pulley which allows reduction of the mass of the counterweight. A cord, supported by the pulley, has the counterweight attached to one end and the writing implement attached to the other end. The counterweight includes a passageway through which the cord to the writing implement passes. Thereby, on extension of the writing implement, the weight will maintain the two cord sections extending from the pulley in general alignment with one another resulting in planar alignment thereof with the pulley to preclude binding of the cord and reduce friction by minimizing interference of the cord with the flanges of the pulley. Twisting of the cord is precluded by employing a cylindrically shaped counterweight which, due to the manner of its engagement with the cord sections, is inclined with respect to the vertical axis and provides a force to counter any twisting tendency of the cord sections.

It is therefore a primary object of the present invention to provide an overhead low friction suspension system for a writing implement which minimizes the pull on the writing implement.

Another object of the present invention is to provide a counterweight retraction mechanism for overhead suspended writing implements.

Still another object of the present invention is to provide a counterweight retraction mechanism for overhead suspended writing implements which maintains the cords supporting the retraction mechanism untwisted during use of the writing implement.

Yet another object of the present invention is to provide a cord supported counterweight system for a retractably suspending writing implements which by the configuration of the counterweight, inherently negates twisting of the supporting cords and encourages untwisting of the cords should they become twisted.

A further object of the present invention is to provide a pivotally attached enclosed suspension pulley system for a writing implement.

A yet further object of the present invention is to provide a jam-proof enclosed suspension pulley for a retractable writing implement suspension system.

These and other objects of the present invention will become apparent to those skilled in the art as the description thereof proceeds.

The present invention may be described with greater specificity and clarity with reference to the following drawings, in which.

Figure 1:
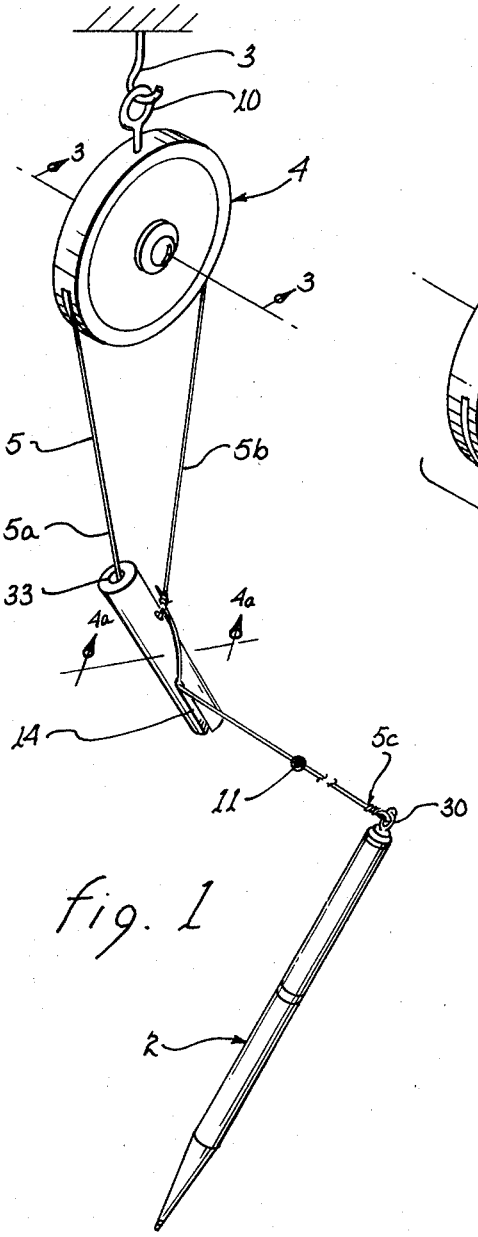
FIG. 1 is a perspective view of a suspension system for a writing implement.
Figure 5:
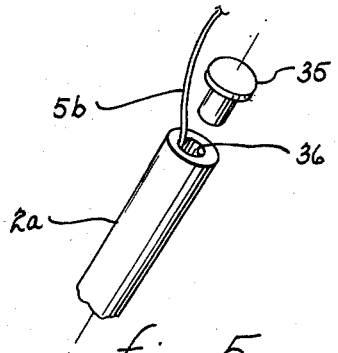
Figure 4B:
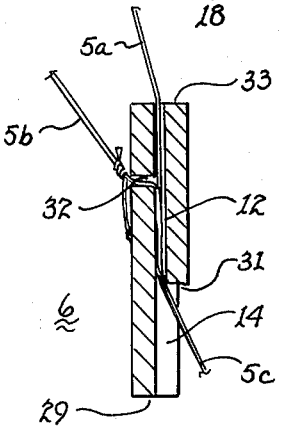
Figure 4A:
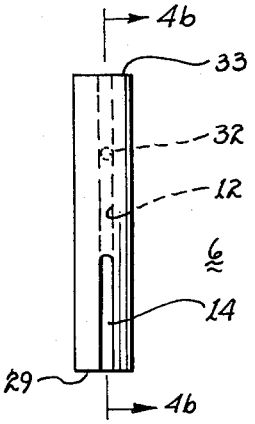

FIG. 4*a* is a cross-sectional view of the counterweight taken along lines 4*a*—4*a*, as shown in FIG. 1;

FIG. 4*b* is a cross-sectional view of the counterweight taken along lines 4*b*—4*b*, as shown in FIG. 4*a*; and FIG. 5 illustrates an alternate method for attaching a writing implement to the suspension system.

Referring to FIG. 1, there is shown a suspension system 1 for suspending a writing implement, such as pen 2, from an overhead attached hook 3. An enclosed pulley device 4 is suspended from hook 3 by means of eyelet 10. The eyelet, in combination with hook 3, provides a substantial degree of freedom about two axes for the pulley device.

The pen is supported by a cord 5 extending from a point of attachment on the counterweight (cord section 5*a*) to the pulley within pulley device 4, to a passageway within counterweight 6 (cord section 56) and to a terminal attachment on the pen (cord section 5*c*) weight 6. As illustrated, the length of cord intermediate the pen and the pulley device is slidably retained within a passageway 12 in the counterweight. The mass of the counterweight is established at a value just sufficient to create a gravity induced force to overcome the gravity induced force of the pen, attendant cord and the friction force present to provide a gently upward retraction force or pull upon the pen.

In operation, extension of pen 2 to a writing surface is accomplished by pulling upon the pen. Such pulling, through operation of pulley device 4, will raise counterweight 6. Since the mass of the counterweight is essentially equivalent to the mass of pen 2, very little restraining force will be exerted upon the attached end of the pen and a writer will hardly notice the pull exerted by cord 5. Certainly, such pull will be too insignificant to preclude normal operation of the pen across a piece of paper or document and only in the event of very rapid pen movement will the restraining force of cord 5 be noticed.

On completion of the writing, the operator can simply release pen 2. Upon release, counterweight 6 will descend and the pen will be retracted to a predetermined height. As the mass of the counterweight is only slightly greater than that of the pen with most of the difference in mass being absorbed by the friction attendant translation of the cord, the acceleration of the pen will be low, yet upward velocity will continue until the predetermined height position is achieved.

Referring again to FIG. 1, certain specific structural configurations of suspension system 1 will be reviewed. A stop member 11 is attached to cord section 5*c* to interfere with passageway 12 within counterweight 6. The function and purpose of stop member 11 is that of limiting the upper vertical position of pen 2 by precluding further downward movement of the counterweight. Thereby, the position of pen 2, when at rest, can be readily modified to a comfortable vertical height above the work surface by simply repositioning stop member 11 along cord section 5*c*.

In some suspension systems incorporating a counterweight, the counterweight depends directly downwardly from a pulley-like mechanism. Such arrangement necessarily requires a segregated vertical corridor through which the counterweight may rise and fall. In many business environments, such a vertical corridor is a practical impossibility. Accordingly, passageway 12 is incorporated within counterweight 6 to slidably receive cord 5 extending to the pen. Such a cooperative relationship reduces the spatial freedom necessary for operation of suspension system 1. Additionally, by slidably attaching counterweight 6 to the cord extending to the pen, both cord sections (5*a*, 5*b*) extending from the counterweight to pulley device 4 will tend to pivotally align the pulley device with the plane defined by the two cord sections. This resulting alignment reduces or eliminates binding of the cord against the flanges of the pulley and further minimizes the binding and friction of the cord at the points of entrance into the pulley device.

Figure 2:
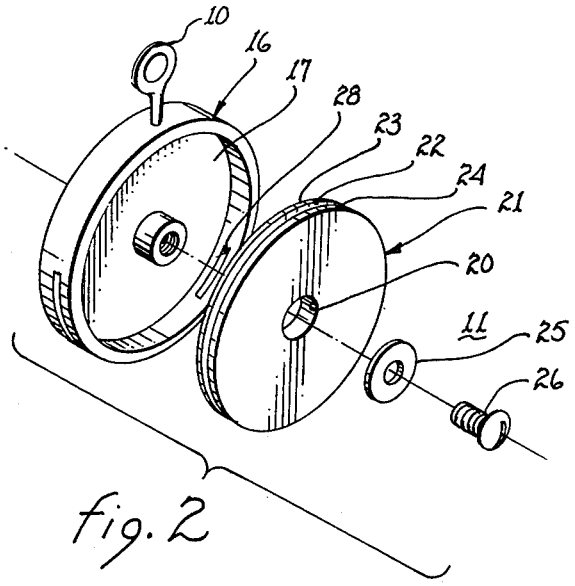
FIG. 2 is an exploded view of the pulley.
Figure 3:
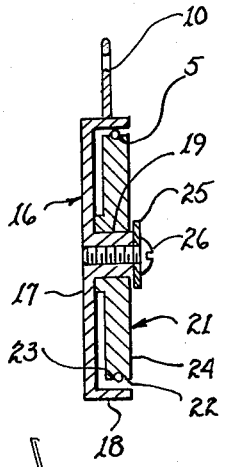
FIG. 3 is a cross-sectional view of the pulley taken along lines 3—3, as shown in FIG. 1.

Pulley device 4, as particularly shown in FIGS. 2 and 3, includes an exterior casing 16 having an end plate 17 and an attached cylindrical member 18. A boss 19 extends from the center of end plate 17 and serves as a journal for aperture 20 in pulley 21. Pulley 21 includes an annular groove 22 defined by flanges 23 and 24. The pulley is secured to casing 16 by mounting the pulley upon boss 19 and maintaining it thereon by washer 25 and machine screw 26. As may be noted in FIG. 3, on tightening of screw 26, the washer bears against the end of the boss and not against the pulley; thereby, the pulley is free to rotate about the boss.

To preclude cord 5 from jumping the pulley, the diametric dimensions of flanges 23 and 24 with respect to the internal diameter of cylindrical member 18 is less than the diameter of the cord. Thus, the cord cannot be inadvertently displaced from groove 22 without withdrawing the pulley from within casing 16. A pair of apertures 27 and 28 are disposed within cylindrical member 18. These apertures are in general planar alignment with groove 22 when the pulley is mounted within the housing. The apertures serve the function of guiding cord 5 onto and off of pulley 21. It may be pointed out that upon exertion of the laterally oriented force upon cord 5, such a force will act upon casing 16 at apertures 27 and 28 to pivotally realign pulley device 4 in the general direction of the laterally oriented force.

The hub of the present invention and which feature distinguishes it over all other known counterweight suspension systems, resides in the structural features of counterweight 6. The counterweight is cylindrically shaped, nominally of lead and 1 5/16 inches long and 5/16 inches in diameter. However, other configurations and sizes which provide the results discussed below could also be incorporated. A passageway 12 extends through the counterweight approximately coincident with the longitudinal axis thereof. A lateral slot 14 extends internally from the cylindrical surface of the counterweight and interconnects with passageway 12. The slot extends longitudinally from end 29 of the counterweight approximately ½ inch. End 31 of the slot may be undercut or sloped to provide a smooth surface for supporting the length of cord extending from passageway 12 and exiting through slot 14. A radially oriented passageway 32, radially aligned with the slot, extends from the cylindrical surface of the counterweight to passageway 12. Nominally, passageway 32 is located 5/16 inches from end 33 of the counterweight.

The counterweight is attached to cord 5 as follows. Cord section 5*a* is threaded through passageway 32, passageway 12 and brought out through slot 14. Thereafter, the cord is brought around the counterweight to form a loop and tied to itself in proximity to the opening to passageway 32, as shown in FIG. 1. Cord section 5*b*, extending from pulley device 4, is threaded through passageway 12 from end 33 of the counterweight and brought out through slot 14. The cord section brought out through the slot and attached to pen 2 is identified by numeral 5*c*.

The operation of counterweight 6 may be described as follows. When pen 2 is pulled down and used for writing, cord 5 extending from pulley device 4 will be at an angle with respect to vertical. At such an angle, cord section 5*c* will engage slot 14. The resulting interference between the walls of the slot and cord section 5*c* will restrain spinning of the counterweight about cord sections 5*b* and 5*c*. In addition, three points of support for the counterweight provided by cord sections 5*a*, 5*b* and 5*c* will produce a resultant support point which is above the centerpoint of mass of the counterweight. Accordingly, the counterweight will be suspended in the manner of a pendulum. And, the counterweight will have no impetus or physical inclination to spin about cord sections 5*b*, 5*c* to twist cord sections 5*a* and 5*b* about one another. This result is maintained at any time pen 2 is laterally displaced from a vertical line passing through supporting hook 3, whether or not the pen is stationary, being extended or being retracted.

Should cord sections 5*a* and 5*b* become inadvertently twisted, the lateral displacement between the points of contact of cord sections 5*a* and 5*b* with the counterweight, in combination with the mass of the counterweight (or, the tension on cord sections 5*a*, 5*b*) will tend to cause the counterweight to spin to untwist the cord sections. This is particularly evident if the counterweight is essentially directly below the pulley device. Spinning of the counterweight to untwist the cord sections if further aided by having cord section 5*c* located along the bottom of the slot (in line with passageway 12) as will occur when the counterweight and pen depend directly downwardly from the pulley mechanism.

It may be pointed out that particularly good results have been achieved in preventing spinning of the counterweight during use of the pen if the slot extends for $\frac{1}{3}$ to $\frac{1}{2}$ of the length of the counterweight. Thereby $\frac{1}{3}$ to $\frac{1}{2}$ of the mass of the counterweight is below the lowest support point of the counterweight whenever cord section 5*c* is inclined off vertical and in engagement with the slot.

The method for attaching pen 2 to the end of cord section 5*c* may be by means of an eyelet 30 secured to the top end of the pen, as illustrated in FIG. 1. However, many other methods may be employed with equal facility. Many commercially available ball point pens include a plug disposed at the upper end of the pen to seal the cavity within which the ink supply is housed. An example of such a pen is illustrated in FIG. 5. Herein, the upper end of pen 2*a* includes a plug 35 for mating with cavity 36 of the pen. By withdrawing plug 35, the end of cord section 5*c* may be inserted within cavity 36. On reinsertion of the plug, the cord will be frictionally gripped intermediate the plug and the side wall of pen 2*a*. It has been found that such attachment is sufficiently robust for all normal uses. Thereby, any one of a plurality of commercially available pens may be employed with the present invention without the need for modifying such pens or requiring specialized construction pens.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. An overhead suspension system for writing implement, said system comprising in combination:

(a) a pulley device for supporting the writing implement;

(b) a counterweight for providing a retraction force acting upon the writing implement;

(c) a cord having a first section affixed to said counterweight and extending into operative engagement with said pulley device, a second section extending from operative engagement with said pulley device into slidable engagement with said counterweight and a third section extending from slidable engagement with said counterweight to a point of attachment on the writing implement;

(d) said counterweight including:

i. a passageway having an ingress for slidably receiving said second section and an egress for slidably receiving said third section; and ii. slot means interconnecting with said passageway for accommodating lateral extension of said third section from said passageway to restrain spinning of said counterweight about said cord sections by the interference between said third section and the walls of said slot means;

iii. means for attaching said first section to said counterweight to a point laterally displaced from the ingress to said passageway to provide a moment arm operating in conjunction with any tension of said first and second sections and urge untwisting of said first and second sections about one another;

whereby, said counterweight restrains twisting of said cord while providing a retraction force for the writing implement.

2. The system as set forth in claim 1 wherein said slot means extends at least from one end of said counterweight and provides a cavity between a part of said passageway and a lateral surface of said counterweight.

3. The system as set forth in claim 2 wherein said attaching means is disposed on a lateral surface of said counterweight in opposed relationship to said slot means and in proximity to the other end of said counterweight.

4. The system as set forth in claim 3 wherein said passageway is generally coincident with the longitudinal axis of said counterweight.

5. The system as set forth in claim 4 wherein said counterweight is a cylinder having a longitudinal axis coincident with said passageway.

6. The system as set forth in claim 5 wherein said slot means is approximately one third the length of said counterweight.

7. The system as set forth in claim 6 wherein said point of attachment is located approximately one fourth of the length of said counterweight from the other end.

8. The system as set forth in claim 7 wherein said point of attachment comprises a further passageway extending from the lateral surface of said counterweight to said passageway and wherein said first section includes a loop penetratingly engaging said further passageway, said passageway and said slot means.

9. The system as set forth in claim 2 wherein said slot means is approximately one third the length of said counterweight.

10. The system as set forth in claim 9 wherein said point of attachment is located approximately one fourth of the length of said counterweight from the other end.

* * * * *